US011462836B2

(12) United States Patent
Kasani

(10) Patent No.: US 11,462,836 B2
(45) Date of Patent: Oct. 4, 2022

(54) BASE STATION ANTENNAS HAVING SKELETAL RADIO FREQUENCY LENSES

(71) Applicant: CommScope Technologies LLC, Hickory, NC (US)

(72) Inventor: Kumara Swamy Kasani, Godavari Khani (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/605,837

(22) PCT Filed: Apr. 10, 2020

(86) PCT No.: PCT/US2020/027643
§ 371 (c)(1),
(2) Date: Oct. 22, 2021

(87) PCT Pub. No.: WO2020/226845
PCT Pub. Date: Nov. 12, 2020

(65) Prior Publication Data

US 2022/0216617 A1 Jul. 7, 2022

Related U.S. Application Data

(60) Provisional application No. 62/845,393, filed on May 9, 2019.

(51) Int. Cl.
*H01Q 19/10* (2006.01)
*H01Q 19/06* (2006.01)
(Continued)

(52) U.S. Cl.
CPC ..... *H01Q 19/108* (2013.01); *H01Q 19/06* (2013.01); *H01Q 19/062* (2013.01); *H01Q 19/10* (2013.01);
(Continued)

(58) Field of Classification Search
CPC .... H01Q 1/246; H01Q 19/108; H01Q 19/062; H01Q 21/24; H01Q 25/007; H01Q 19/10; H01Q 19/06; H01Q 25/00
(Continued)

(56) References Cited

U.S. PATENT DOCUMENTS 6,590,544 B1 * 7/2003 Filipovic ..... H01Q 19/062 343/753
9,819,094 B2 11/2017 Matitsine et al.
(Continued)

FOREIGN PATENT DOCUMENTS

WO 2020096896 A1 5/2020

OTHER PUBLICATIONS

"International Search Report and Written Opinion of the International Searching Authority", International Application No. PCT/US2020/027643, dated Jul. 16, 2020, 10 pp.

*Primary Examiner* — Hai V Tran
(74) *Attorney, Agent, or Firm* — Myers Bigel, P.A.

(57) ABSTRACT

A lensed base station antenna includes a first array that includes a plurality of radiating elements that are configured to transmit respective sub-components of a first RF signal, a second array that includes a plurality of radiating elements that are configured to transmit respective sub-components of a second RF signal and a skeletal RF lens positioned to receive electromagnetic radiation from a first of the radiating elements of the first array and from a first of the radiating elements of the second array. In some embodiments, the skeletal RF lens includes a plurality of layers of dielectric material that are separated by air gaps.

21 Claims, 12 Drawing Sheets

(51) Int. Cl.
*H01Q 21/24* (2006.01)
*H01Q 25/00* (2006.01)
*H01Q 1/24* (2006.01)

(52) U.S. Cl.
CPC ..... *H01Q 21/24* (2013.01); *H01Q 25/00* (2013.01); *H01Q 25/007* (2013.01); *H01Q 1/246* (2013.01)

(58) Field of Classification Search
USPC ..... 343/702
See application file for complete search history.

(56) References Cited

U.S. PATENT DOCUMENTS

| | | | | |
|---|---|---|---|---|
| 2003/0006941 | A1* | 1/2003 | Ebling | H01Q 25/008 343/911 L |
| 2007/0296630 | A1 | 12/2007 | Schwerin | |
| 2007/0296640 | A1* | 12/2007 | Colburn | H01Q 25/007 343/783 |
| 2010/0207833 | A1 | 8/2010 | Toso et al. | |
| 2015/0070230 | A1* | 3/2015 | Bradley | H01Q 1/42 343/753 |
| 2015/0263424 | A1 | 9/2015 | Sanford et al. | |

* cited by examiner

BASE STATION ANTENNAS HAVING SKELETAL RADIO FREQUENCY LENSES

CROSS-REFERENCE TO RELATED APPLICATIONS

The present application is a 35 U.S.C. § 371 national stage application of PCT Application No. PCT/US2020/027643, filed on Apr. 10, 2020, which itself claims priority to U.S. Provisional Patent Application No. 62/845,393, filed May 9, 2019, the entire contents of both of which are incorporated herein by reference in their entireties.

FIELD OF THE INVENTION

The present invention generally relates to radio communications and, more particularly, to lensed antennas utilized in cellular and other communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

A common base station configuration is a "three sector" configuration in which the cell is divided into three 120° sectors in the azimuth plane, and the base station includes three base station antennas that provide coverage to the three respective sectors. The azimuth plane refers to a horizontal plane that bisects the base station antenna that is parallel to the plane defined by the horizon. In a three sector configuration, the antenna beams generated by each base station antenna typically have a Half Power Beam Width ("HPBW") in the azimuth plane of about 65° so that the antenna beams provide good coverage throughout a 120° sector. Typically, each base station antenna will include a vertically-extending column of radiating elements that is typically referred to as a "linear array." Each radiating element in the linear array may have a HPBW of approximately 65° so that the antenna beam generated by the linear array will provide coverage to a 120° sector in the azimuth plane. In many cases, the base station antenna may be a so-called "multi-band" that includes two or more arrays of radiating elements that operate in different frequency bands.

Sector-splitting refers to a technique where the coverage area for a base station is divided into more than three sectors in the azimuth plane, such as six, nine or even twelve sectors. A six-sector base station will have six 60° sectors in the azimuth plane. Splitting each 120° sector into multiple smaller sub-sectors increases system capacity because each antenna beam provides coverage to a smaller area, and therefore can provide higher antenna gain and/or allow for frequency reuse within a 120° sector. In sector-splitting applications, a single multibeam antenna is typically used for each 120° sector. The multibeam antenna generates two or more antenna beams within the same frequency band, thereby splitting the sector into two or more smaller sub-sectors.

One technique for implementing a multibeam antenna is to mount two or more linear arrays of radiating elements that operate in the same frequency band within an antenna that are pointed at different azimuth angles, so that each linear array covers a pre-defined portion of a 1200 sector such as, for example, half of the 120° sector (for a dual-beam antenna) or a third of the 120° sector (for a tri-beam antenna). Since the azimuth beamwidth of typical radiating elements is usually appropriate for covering a full 120° sector, an RF lens may be mounted in front of the linear arrays of radiating elements that narrows the azimuth beamwidth of each antenna beam by a suitable amount for providing service to a sub-sector. Unfortunately, however, the use of RF lenses may increase the size, weight and cost of the base station antenna, and there may be other issues associated with the use RF lenses.

SUMMARY

Pursuant to embodiments of the present invention, lensed base station antennas are provided that include a first array that includes a plurality of radiating elements that are configured to transmit respective sub-components of a first RF signal, a second array that includes a plurality of radiating elements that are configured to transmit respective sub-components of a second RF signal and a skeletal RF lens positioned to receive electromagnetic radiation from a first of the radiating elements of the first array and from a first of the radiating elements of the second array. The skeletal RF lens includes a plurality of layers of dielectric material that are separated by air gaps.

In some embodiments, the plurality of layers of dielectric material may comprise at least one of a plurality of spaced-apart sheets of dielectric material and a plurality of concentric cylinders of dielectric material.

In some embodiments, the base station antenna may extend along a longitudinal axis, and a thickness of at least some of the layers of dielectric material in a depth dimension of the base station antenna may be at least 6 millimeters.

In some embodiments, the plurality of layers of dielectric material may comprise a plurality of spaced-apart sheets of dielectric material that are substantially parallel to each other. The spaced-apart sheets of dielectric material may be spaced apart from each other in a depth dimension of the base station antenna.

In some embodiments, the spaced-apart sheets of dielectric material that are arranged to be substantially parallel to each other may comprise a first set of spaced-apart sheets of dielectric material, and the RF lens may further include a second set of sheets of dielectric material that each extend at a respective angle with respect to the sheets of dielectric material in the first set of spaced-apart sheets of dielectric material.

In some embodiments, a thickness of at least some of the spaced-apart sheets of dielectric material in a depth dimension of the base station antenna may be between 6 millimeters and 12 millimeters, and at least two adjacent ones of the spaced-apart sheets of dielectric material may be separated by between 15 millimeters and 40 millimeters.

In some embodiments, the plurality of spaced-apart sheets of dielectric material that are arranged to be substantially parallel to each other may include a proximate sheet of dielectric material that is closest to the first array, a distal sheet of dielectric material that is farthest from the first array and at least one central sheet of dielectric material that is between the proximate sheet of dielectric material and the distal sheet of dielectric material. A width of the at least one central sheet of dielectric material may exceed a width of the proximate sheet of dielectric material and a width of the distal sheet of dielectric material.

In some embodiments, the plurality of spaced-apart sheets of dielectric material that are arranged to be substantially parallel to each other may include at least five spaced-apart sheets of dielectric material.

In some embodiments, the plurality of layers of dielectric material may comprise a plurality of spaced-apart sheets of dielectric material, and the RF lens may also include a plurality of dielectric fasteners that connect adjacent ones of the spaced-apart sheets of dielectric material.

In some embodiments, the first and second arrays may be configured to form respective first and second antenna beams, and a respective azimuth boresight pointing direction of each of the first and second antenna beams may extend through at least four air-filled channels.

In some embodiments, the RF lens may be substantially free of metal.

In some embodiments, a blended dielectric constant of the RF lens along a boresight pointing direction of the first array substantially may comprise an average of the dielectric constant of the layers of dielectric material and the dielectric constant of air, that is weighted based on the amount of dielectric material and the amount of air that is present along the boresight pointing direction of the first array.

In some embodiments, the plurality of layers of dielectric material may comprise a plurality of spaced-apart sheets of dielectric material that are arranged to be substantially parallel to each other and substantially perpendicular to an azimuth boresight pointing direction of the base station antenna.

In some embodiments, the plurality of layers of dielectric material may comprise a plurality of spaced-apart sheets of dielectric material that are arranged to be substantially parallel to each other and substantially perpendicular to an azimuth boresight pointing direction of the first array.

In some embodiments, the RF lens may be a cylindrical RF lens.

Pursuant to further embodiments of the present invention, lensed base station antennas are provided that include a first array that includes a plurality of radiating elements that are configured to transmit respective sub-components of a first RF signal, a second array that includes a plurality of radiating elements that are configured to transmit respective sub-components of a second RF signal, and a skeletal RF lens positioned to receive electromagnetic radiation from a first of the radiating elements of the first array and from a first of the radiating elements of the second array. The skeletal RF lens comprises a plurality of spaced-apart sheets of dielectric material that are arranged to be substantially parallel to each other.

In some embodiments, the spaced-apart sheets of dielectric material may be substantially perpendicular to an azimuth boresight pointing direction of the base station antenna.

In some embodiments, the base station antenna may extend along a longitudinal axis, and a thickness of at least some of the spaced-apart sheets of dielectric material in a depth dimension of the base station antenna may be at least 6 millimeters.

In some embodiments, the spaced-apart sheets of dielectric material may be spaced apart from each other in a depth dimension of the base station antenna.

In some embodiments, the plurality of spaced-apart sheets of dielectric material that are arranged to be substantially parallel to each other may comprise a first set of spaced-apart sheets of dielectric material, and the RF lens may also include a second set of sheets of dielectric material that each extend at a respective angles with respect to the sheets of dielectric material in the first set of spaced-apart sheets of dielectric material.

In some embodiments, a thickness of at least some of the spaced-apart sheets of dielectric material in a depth dimension of the base station antenna may be between 6 millimeters and 12 millimeters, and at least two adjacent ones of the spaced-apart sheets of dielectric material may be separated by between 15 millimeters and 40 millimeters.

In some embodiments, the plurality of spaced-apart sheets of dielectric material that are arranged to be substantially parallel to each other may include at least five spaced-apart sheets of dielectric material.

In some embodiments, an interior of the RF lens may substantially consist of sheets of dielectric material separated by air-filled chambers.

Pursuant to still further embodiments of the present invention, lensed base station antennas are provided that include a first array that includes a plurality of radiating elements that are configured to transmit respective sub-components of a first RF signal, a second array that includes a plurality of radiating elements that are configured to transmit respective sub-components of a second RF signal, and an RF lens positioned to receive electromagnetic radiation from a first of the radiating elements of the first array and from a first of the radiating elements of the second array. A section of the RF lens that extends along an azimuth boresight pointing direction of a first radiating element of the first array comprises at least first through fourth regions of dielectric material that are at least 3 millimeters thick and that have a dielectric constant of at least 2.5, where each of the first through fourth regions of dielectric material are separated by respective first through third air gaps In some embodiments, an interior of the RF lens substantially may comprise sheets of dielectric material separated by air-filled chambers.

In some embodiments, a thickness of each of the first through fourth regions of dielectric material may be at least 6 millimeters.

In some embodiments, the first through fourth regions of dielectric material may comprise first through fourth spaced-apart sheets of dielectric material that are arranged to be substantially parallel to each other.

In some embodiments, a thickness of each of the first through fourth spaced-apart sheets of dielectric material in a depth dimension of the base station antenna may be between 6 millimeters and 12 millimeters, and at least two adjacent ones of the first through fourth spaced-apart sheets of dielectric material may be separated by between 15 millimeters and 40 millimeters.

In some embodiments, the first through fourth spaced-apart sheets of dielectric material may be interconnected by a plurality of dielectric fasteners that connect adjacent ones of the spaced-apart sheets of dielectric material.

DETAILED DESCRIPTION

Figure 1A:
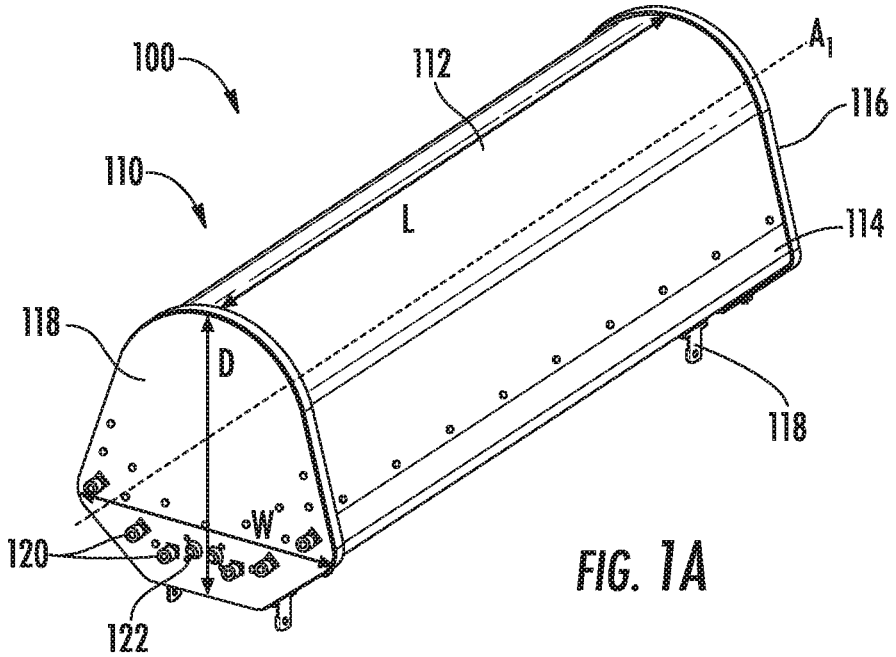
FIG. 1A is a perspective view of a lensed base station antenna according to embodiments of the present invention.

As discussed above, one approach for implementing sector splitting is providing base station antennas having two or more arrays of radiating elements that point to different portions of a sector, and using an RF lens to narrow the azimuth beamwidths of the antenna beams generated by the arrays so that the antenna beams are sized to provide coverage to respective portions or "sub-sectors" of the sector. The RF lenses may be formed of dielectric materials, and generally speaking the higher the dielectric constant of the lens material, the more RF focusing that will occur. State of the art lensed base station antennas include RF lenses that are formed using so-called "artificial" dielectric materials as the RF energy focusing material that narrows the azimuth beamwidths of the antenna beams. These artificial dielectric materials include small pieces of metal that are dispersed within a dielectric base material to create a composite material that has electromagnetic properties that similar to those of high dielectric constant dielectric materials. These artificial dielectric materials may be lightweight and have a relatively high dielectric constant (e.g., a dielectric constant between 1.8 and 2.2) that is sufficient to narrow the azimuth beamwidth a desired amount.

While RF lenses provide a convenient mechanism for implementing sector-splitting, the artificial dielectric materials used in these lenses may be expensive, and the metal particles that are included in the artificial dielectric materials are a potential source of passive intermodulation ("PIM") distortion. PIM distortion is of particular concern in base station antenna applications, as a single source of PIM distortion can dramatically reduce the performance of a cellular base station. Additionally, a portion of the RF energy that is injected into the RF lens of a lensed base station antenna may be converted to heat within the RF lens, and if the RF lens heats up too much, the RF energy focusing material of the RF lens may be damaged and the electromagnetic properties thereof changed, degrading the performance of the antenna.

Pursuant to embodiments of the present invention, lensed base station antennas are provided that include skeletal RF lenses that may be formed using inexpensive, readily available dielectric materials such as polyvinyl chloride ("PVC"), acrylonitrile butadiene styrene ("ABS"), and the like. These RF lenses may be formed, for example, by injection molding, extrusion, and/or by mounting sheets of the dielectric material within the antenna. The RF lenses according to embodiments of the present invention may be "skeletal" structures that comprise spaced-apart layers of dielectric materials that are separated by air gaps so that the RF lenses comprise open-spaced frames. Thus, the RF lenses may be inexpensive and easy to fabricate. By using layers dielectric materials that have higher dielectric constants (e.g., dielectric constants of 2.5 or more) that are separated by air gaps, RF lenses can be formed that have "blended" dielectric constants that are comparable to the dielectric constants of RF lenses formed using artificial dielectric materials, but at lower cost. Moreover, the RF lenses according to embodiments of the present invention may be free of any metal and hence will not be a potential source of PIM distortion. Additionally, since the RF lenses according to embodiments of the present invention include air channels between the dielectric materials and may be formed of materials that are less susceptible to heat damage, they may not require any special heat dissipation elements for venting heat from the RF lenses. The RF lenses according to embodiments of the present invention may also weigh less than comparable state-of-the-art RF lenses, and may avoid the potential need to include RF absorber material antenna that are sometimes used to reduce PIM distortion.

The spaced-apart layers of dielectric material that are used to form the RF lenses according to embodiments of the present invention may have a wide variety of different configurations. Generally speaking, the spaced-apart layers of dielectric material may be designed so that, for each array of radiating elements that is mounted behind the RF lens, the RF energy emitted by the array along each azimuth angle in the array's sub-sector of operation will pass through a total thickness of dielectric material that, for the dielectric constant(s) of the material, will result in a desired amount of focusing of the RF energy in the azimuth plane.

Typically, RF lens are filled with dielectric materials (or artificial dielectric materials) that have a dielectric constant that is greater than 1. As a result, RF energy passing through such RF lenses is focused as it passes through all different portions of the RF lens. In sharp contrast, the skeletal RF lenses according to embodiments of the present invention contain large air channels where the RF energy is not focused, so that the RF energy alternatingly passes through relatively thin sections of relatively high dielectric constant material where the RF energy is highly focused and then through thicker air channels where the RF energy is not focused. It has been discovered that this approach may accomplish the necessary focusing of the RF energy using much cheaper and easier to fabricate RF lens structures. Additionally, the air channels act as heat dissipation channels, and the RF lens may be formed solely of dielectric materials (i.e., without the use of any metal) allowing for PIM distortion-free RF lens structures.

The base station antennas according to embodiments of the present invention may be multibeam antennas that can be used for sector-splitting applications. In some embodiments, these multibeam base station antennas may include at least first and second arrays of radiating elements that are configured to operate in the same frequency band and an RF lens that is positioned to receive electromagnetic radiation from the first and second arrays. The RF lens may be a skeletal RF lens. In some embodiments, the skeletal RF lens includes a plurality of layers of dielectric material that are separated by air gaps. In some embodiments, a section of the RF lens that extends along an azimuth boresight pointing direction of a first radiating element of the first array comprises at least first through fourth regions of dielectric material that are at least 3 millimeters thick and that have a dielectric constant of at least 2.5, where each of the first through fourth regions of dielectric material are separated by respective first through third air gaps.

In some embodiments, the layers of dielectric material may comprise a plurality of parallel, spaced-apart sheets of dielectric material and/or a plurality of concentric cylinders of dielectric material. At least some of the layers of dielectric material may have a thickness of at least 6 millimeters, and at least some of the layers may be spaced apart from adjacent layers by air gaps that have more than twice the thickness of the layers of dielectric material. In one example embodiment, the spaced-apart sheets of dielectric material have a thickness in a depth dimension of the antenna of between 6 millimeters and 12 millimeters, and adjacent ones of the spaced-apart sheets of dielectric material have a center-to-center separations of between 15 millimeters and 40 millimeters Embodiments of the present invention will now be discussed in greater detail with reference to the attached figures, in which example embodiments are shown.

Figure 1B:
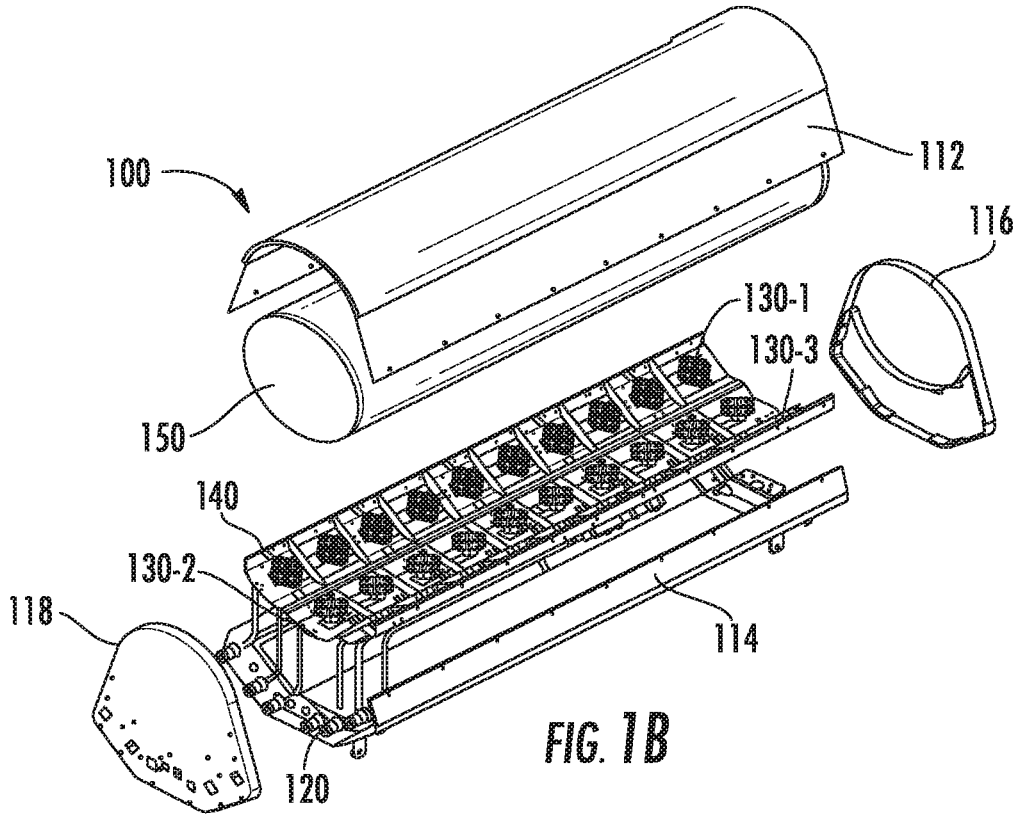
FIG. 1B is an exploded perspective view of the lensed base station antenna of FIG. 1A.
Figure 1C:
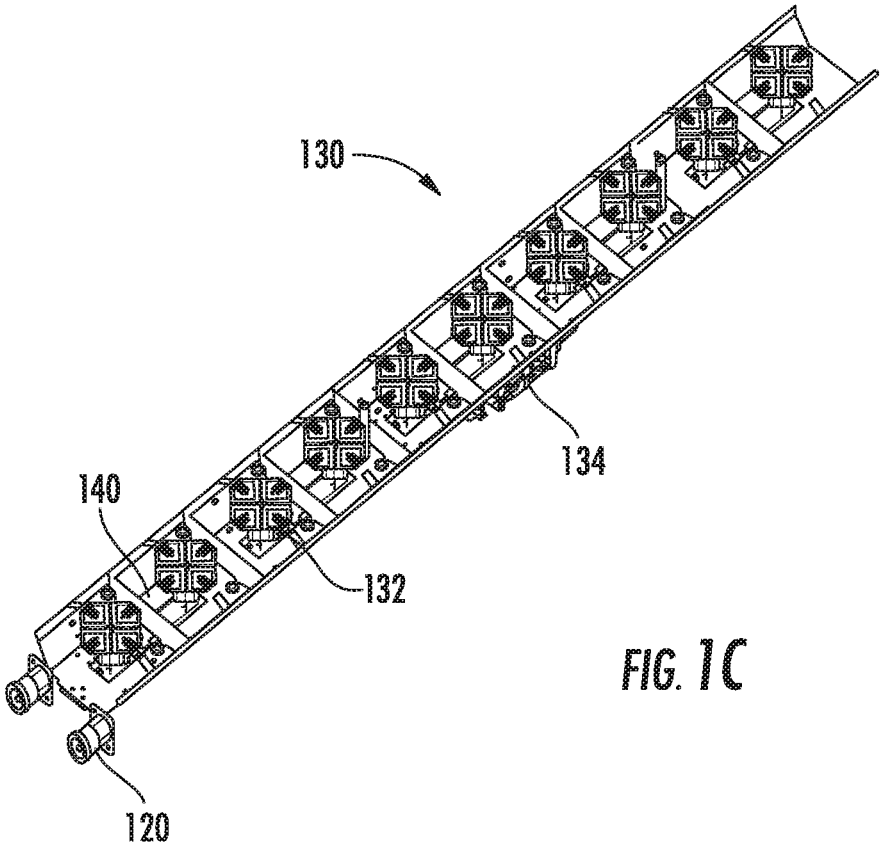
FIG. 1C is an enlarged perspective view of one of the linear arrays of radiating elements illustrated in FIG. 1B.
Figure 1D:
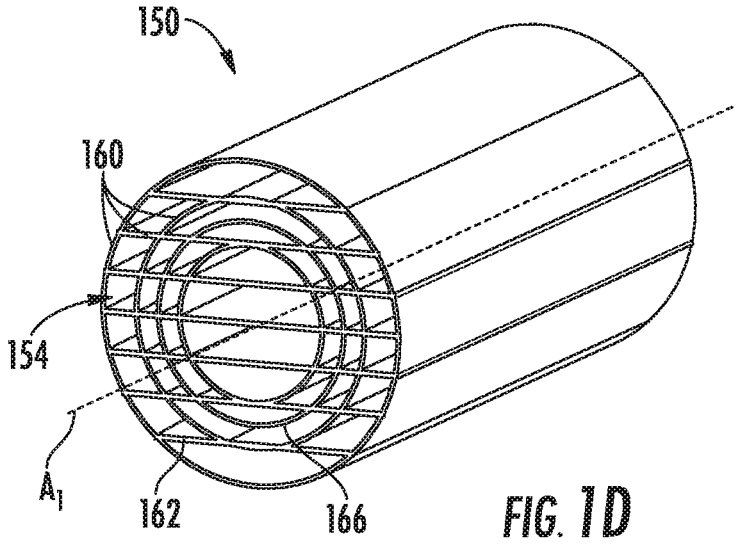
FIG. 1D is a perspective view of the RF lens illustrated in FIG. 1B.
Figure 1E:
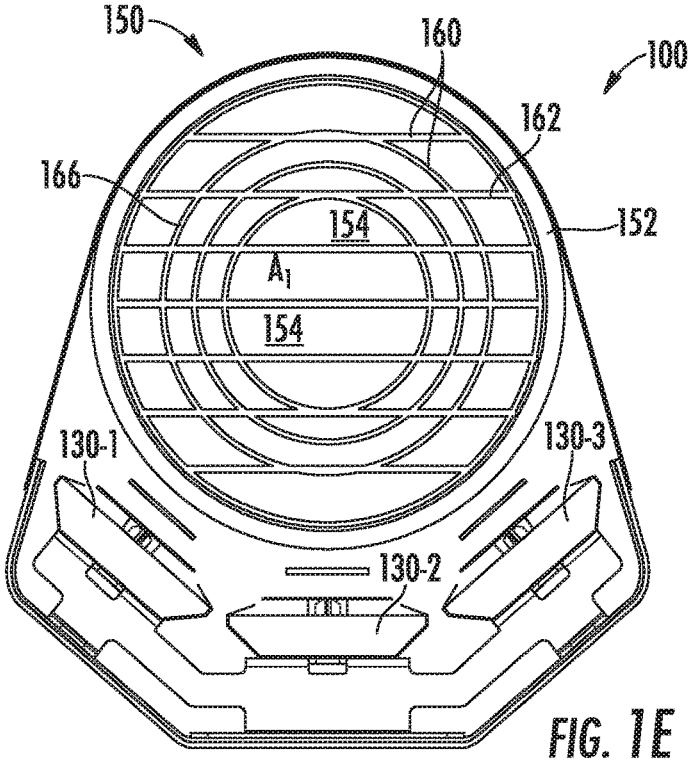
FIG. 1E is a transverse cross-sectional view of the base station antenna of FIGS. 1A-1B.
Figure 1F:
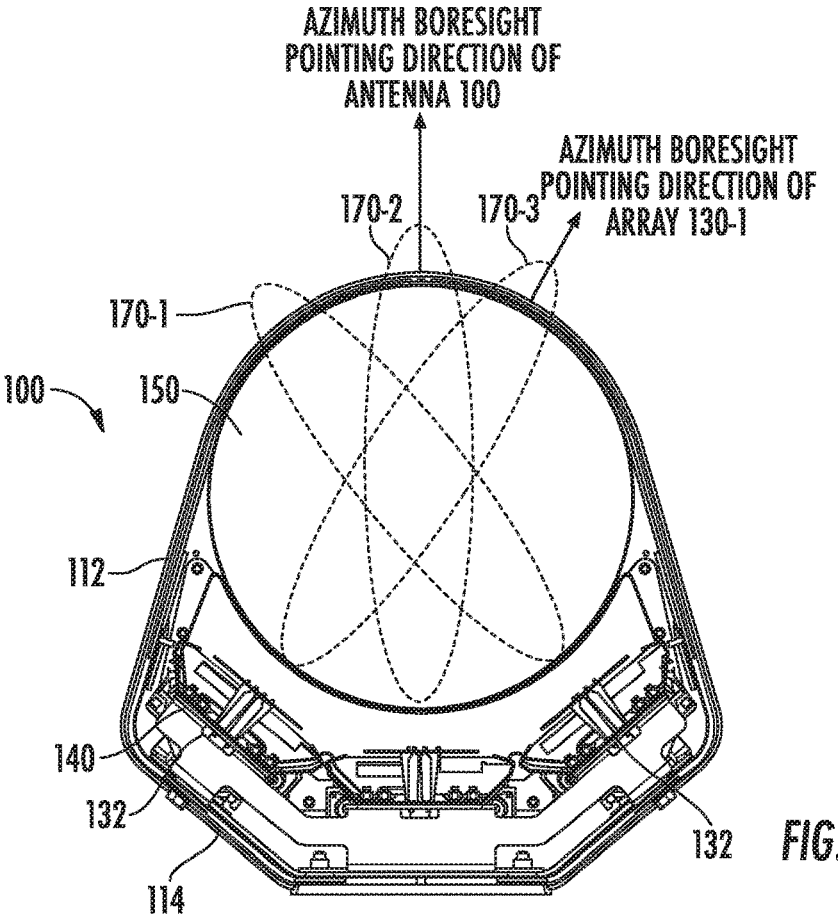
FIG. 1F is a schematic top view of the base station antenna of FIGS. 1A-1B with the top cap removed that illustrates the antenna beams formed by the antenna.

Reference is now made to FIGS. 1A-1F, which illustrate a lensed multibeam base station antenna 100 according to an example embodiment of the present invention. In particular, FIGS. 1A and 1B are a perspective view and an exploded perspective view, respectively, of the lensed multibeam base station antenna 100. FIG. 1C is an enlarged perspective view of one of the linear arrays of radiating elements illustrated in FIG. 1B. FIG. 1D is a perspective view of the RF lens illustrated in FIG. 1B, and FIG. 1E is a transverse cross-sectional view of the base station antenna 100 taken through the RF lens. Finally, FIG. 1F is a schematic top view of the base station antenna of FIGS. 1A-1B with the top cap removed.

Referring first to FIGS. 1A-1B, the lensed multibeam base station antenna 100 includes a housing 110. In the depicted embodiment, the housing 110 is a multi-piece housing that includes a radome 112, a tray 114, a top end cap 116 and a bottom end cap 118. Brackets may extend from the rear side of the tray 114 that are used to mount the antenna 100 on an antenna mount structure. A plurality of RF ports 120 and control ports 122 may be mounted in the bottom end cap 118. The RF ports 120 may comprise RF connectors that may receive coaxial cables that provide RF connections between the base station antenna 100 and one or more radios (not shown). The control ports 122 may comprise connectors that receive control cables that may be used to send control signals to the antenna 100.

The radome 112, end caps 116, 118 and tray 114 may provide physical support and environmental protection to the antenna 100. The end caps 116, 118, radome 112 and tray 114 may be formed of, for example, extruded plastic, and may comprise multiple parts or implemented as a single piece. For example, the radome 112 and the top end cap 116 may be implemented as a monolithic element. In some embodiments, an RF absorber (not shown) can be placed between the tray 114 and the radiating elements 132 (discussed below). The RF absorber may help reduce passive intermodulation ("PIM") distortion that may be generated because the metal tray 114 and a metal reflector 140 (discussed below) may create a resonant cavity that generates PIM distortion.

As is also shown in FIG. 1A, the base station antenna 100 is an elongated structure that extends along a longitudinal axis $A_1$. The azimuth boresight pointing direction of the base station antenna 100 refers to a horizontal axis extending from the base station antenna 100 to the center, in the azimuth plane, of the sector served by the base station antenna. When the base station antenna 100 is mounted for normal use, the longitudinal axis $A_1$ will typically extend along a vertical axis, although in some cases the base station antenna 100 may be tilted a few degrees from the vertical to impart a mechanical downtilt to the antenna beams formed by the base station antenna 100. As is further shown in FIG. 1A, the base station antenna 100 has a length, a depth and a width. The length L of base station antenna 100 refers to the distance that the antenna extends along the longitudinal axis $A_1$. The depth D of antenna 100 refers to the distance that the antenna extends along an axis $A_2$ that is perpendicular to the longitudinal dimension $A_1$ and that is collinear with the azimuth boresight pointing direction of the base station antenna 100. The width dimension W of the base station antenna 100 refers to the distance that the antenna extends along an axis $A_3$ that is perpendicular to both axis $A_1$ and axis $A_2$.

Referring to FIGS. 1B and 1C, the base station antenna 100 further includes one or more linear arrays 130-1, 130-2, and 130-3 of radiating elements 132. Herein, when multiple of the same elements are included in an antenna the elements may be referred to individually by their full reference numeral (e.g., linear array 130-3) and collectively by the first part of their reference numerals (e.g., the linear arrays 130). Each linear array 130 includes a plurality of radiating elements 132. While the radiating elements 132 included in each linear array 130 are illustrated in FIGS. 1B-IC as cross-polarized "box" dipole radiating elements 132 that have four dipole arms mounted on feed stalk printed circuit boards that form a pair of slant −45°/+45° dipole radiators that emit RF energy with −45° and +45° polarizations, respectively, it will be appreciated that any appropriate radiating elements 132 may be used. For example, single polarization dipole radiating elements or patch radiating elements may be used in other embodiments.

As will be discussed in greater detail below, the base station antenna 100 includes a cylindrical RF lens 150 that narrows the azimuth beamwidth of each linear array 130.

The use of a cylindrical lens such as RF lens 150 may reduce grating lobes (and other far sidelobes). The reduction in grating lobes may also advantageously allow for increased spacing between adjacent radiating elements 132, potentially allowing for a 20-30% reduction in the number of radiating elements 132 included in each linear array 130, as is explained in U.S. Pat. No. 9,819,094.

Each linear array 130 may be mounted to extend forwardly from a reflector 140. In the depicted embodiment, each linear array 130 includes a separate reflector 140, although it will be appreciated that a monolithic reflector 140 that serves as the reflector for all three linear arrays 130 may be used in other embodiments. Each reflector 140 may comprise a metallic sheet that serves as a ground plane for the radiating elements 132 and that also redirects forwardly much of the backwardly-directed radiation emitted by the radiating elements 132. As shown in FIG. 1C, each linear array 130 may further include an associated phase shifter/divider 134. The divider portion of each phase shifter/divider 134 may divide an RF signal in the transmit path into a plurality of sub-components (and may combine a plurality of received sub-components of an RF signal in the receive path). The phase shifter portion of the phase shifter/divider 134 may be used to inject a phase taper across the sub-components of the RF signal in order to change the elevation angle of the resulting antenna beam in a desired fashion. One or more phase shifter/dividers 134 may be provided for each linear array 130. As is further shown in FIG. 1C, two of the RF connectors 120 may be used to pass signals between each linear array 130 and a radio (not shown), namely an RF signal at each of two orthogonal polarizations. While the antenna 100 includes three linear arrays 130, it will be appreciated that different numbers of linear arrays 130 may be used. For example, two or four linear arrays 130 may be used in other embodiments.

FIGS. 1B and 1D-1E illustrate the RF lens 150 that is included in base station antenna 100. The RF lens 150 may be positioned in front of the linear arrays 130 so that the azimuth boresight pointing direction of each linear array 130 points at the central longitudinal axis of the RF lens 150 (which may be the above-referenced longitudinal axis $A_1$ of the base station antenna 100). In some embodiments, each linear array 130 may have approximately the same length as the RF lens 150. When the antenna 100 is mounted for use, the azimuth plane is generally perpendicular to the central longitudinal axis $A_1$ of the RF lens 150.

As discussed above, conventional lensed base station antennas may suffer from several issues, including increased cost, PIM distortion and/or heat dissipation issues that may negatively affect the electromagnetic properties of the RF energy focusing material of the RF lens. The RF lenses according to embodiments of the present invention may avoid these problems associated with conventional RF lenses, as will be explained in further detail herein.

The RF lens 150 may or may not include an outer dielectric shell 152. The RF lens 150 may be a skeletal lens that includes spaced-apart layers of dielectric material 160. These spaced apart layers of dielectric material 160 may define air-filled channels 154 that may have either open or closed side surfaces. The tops and bottoms of the air-filled channels 154 may likewise be either open or closed. The spaced-apart layers of dielectric material 160 may define an open-spaced frame. In some embodiments, the spaced-apart layers of dielectric material 160 may include a plurality of flat sheets of dielectric material 162 that are spaced-apart from one another and that may define parallel planes. In some embodiments, one or more additional flat sheets of dielectric material 164 (see FIG. 6A), cylindrical sheets of dielectric material 166 or the like may connect the parallel flat sheets of dielectric material 162 so that the RF lens is a monolithic structure. In other embodiments, dielectric spacers 156 and/or dielectric fasteners 158 (e.g., plastic screws) may be provided that are used to space the layers of dielectric material 160 apart from one another and which optionally can be used to connect the layers of dielectric material 160 to each other so that the RF lens 150 may be installed in the base station antenna 100 as a one-piece structure.

The spaced-apart layers of dielectric material 160 may act as an RF energy focusing material. In some embodiments, all of the layers of dielectric material 160 may be formed using the same type of dielectric material so that the material forming the skeletal lens 150 has a constant dielectric constant. In other embodiments, two or more different dielectric materials may be used to form the skeletal RF lens 150. For example, the spaced-apart layers of dielectric material 160 may be formed of a dielectric material having a first dielectric constant and the spacers 156 and/or fasteners 158 may be formed using one or more additional materials that have other dielectric constants. In still other embodiments, some of the spaced-apart layers of dielectric material 160 (e.g., a plurality of parallel flat sheets of dielectric material 162) may have a first dielectric constant while others of the spaced-apart layers of dielectric material 160 (e.g., additional of the parallel flat sheets of dielectric material 162 or other sheets of dielectric material 164) may have a second dielectric constant that is different from the first dielectric constant.

In some embodiments, some or all of the layers of dielectric material 160 that form the RF lens 150 may be a conventional, relatively lightweight dielectric material such as PVC, ABS, polyetherimide ("PEI", which is sold under the brand name Ultem™), polyether ether ketone ("PEEK"), fiberglass, polytetrafluoroethylene material or the like. PVC may have a dielectric constant of, for example, between about 2.8 and 3.5 depending upon the particular formulation of the PVC. ABS typically has a dielectric constant of about 3.0, while PEI has a dielectric constant of about 3.1. In some example embodiments, the solid dielectric material used to form the majority of the RF lenses according to embodiments of the present invention may have a dielectric constant between about 2.5 and 4.0, and between about 2.8 and 3.5 in other embodiments. The amount of dielectric material included in the RF lenses according to embodiments of the present invention may be selected so that the RF lens will have an "effective" dielectric constant of about 1.7-2.3 in some embodiments of the present invention, where the "effective" dielectric constant corresponds to the dielectric constant of a same-sized RF lens that is formed of a homogenous dielectric material. In other words, the RF lens according to embodiments of the present invention may perform substantially the same amount of focusing as conventional, solid RF lenses formed of dielectric material having a dielectric constant in the range of 1.7-2.3 in some embodiments.

Since the base station antenna 100 includes cross-polarized radiating elements 132, each linear array 130 may generate two antenna beams 170, namely an antenna beam 170 at each of the two polarizations. Three antenna beams 170-1, 170-2, 170-3 that are generated by the respective linear arrays 130-1, 130-2, 130-3 are illustrated schematically in FIG. 1F. Only three antenna beams 170 are illustrated in FIG. 1F as the two antenna beams 170 formed at orthogonal polarizations by each linear array 130 may have substantially identical shapes and pointing directions. The centers of the antenna beams 170 formed by each linear array 130 (i.e., the azimuth boresight pointing directions of each linear array 130) are pointed at azimuth angles of −40°, 0°, and 40°, respectively with respect to the azimuth boresight pointing direction of the base station antenna 100. Thus, the three linear arrays 130 generate antenna beams 170 that together provide coverage to a 120° sector in the azimuth plane.

The RF lens 150 may shrink the 3 dB beamwidth of each antenna beam 170-1, 170-2, 170-3 from about 65° to about 23°-25° in the azimuth plane. By narrowing the azimuth beamwidth of each antenna beam 170, the RF lens 150 increases the gain of each antenna beam 170 by, for example, about 4-5 dB. The higher antenna gains allow the multibeam base station antenna 100 to support higher data rates at the same quality of service. The multibeam base station antenna 100 may also reduce the antenna count for the base station.

As can be seen with reference to FIGS. 1E and 1F, the azimuth boresight pointing direction for each of antenna beams 170-1, 170-2, 170-3 extends through a large number of air-filled channels 154 as well as through a large number of dielectric layers 160.

While the RF lens 150 has a generally cylindrical shape, it will be appreciated that the RF lens 150 may have other shapes including a spherical shape, an ellipsoid shape, an elongate elliptical cylinder shape and the like, and that more than one RF lens 150 may be included in the antenna 100 in other embodiments of the present invention.

As described above, the RF lens 150 may be made solely of dielectric materials. Consequently, there may not be any metal in the RF lens 150 that may act as a potential source of PIM distortion. Moreover, the RF lens 150 may be formed of inexpensive, readily available dielectric materials and can be readily fabricated, for example, from sheet material or by a simple extrusion process. Thus, the RF lens 150 may be less expensive as compared to state-of-the-art RF lenses that exhibit similar performance levels. Additionally, as described above, the RF lens 150 may include a large number of air-filled channels 154. These air filled channels 154 may provide paths for dissipating heat that may be generated within the RF lens 150 due to the absorption of RF energy by the RF lens 150, and hence may ensure that thermal issues do not degrade the performance of the lensed base station antenna 100.

Figure 2:
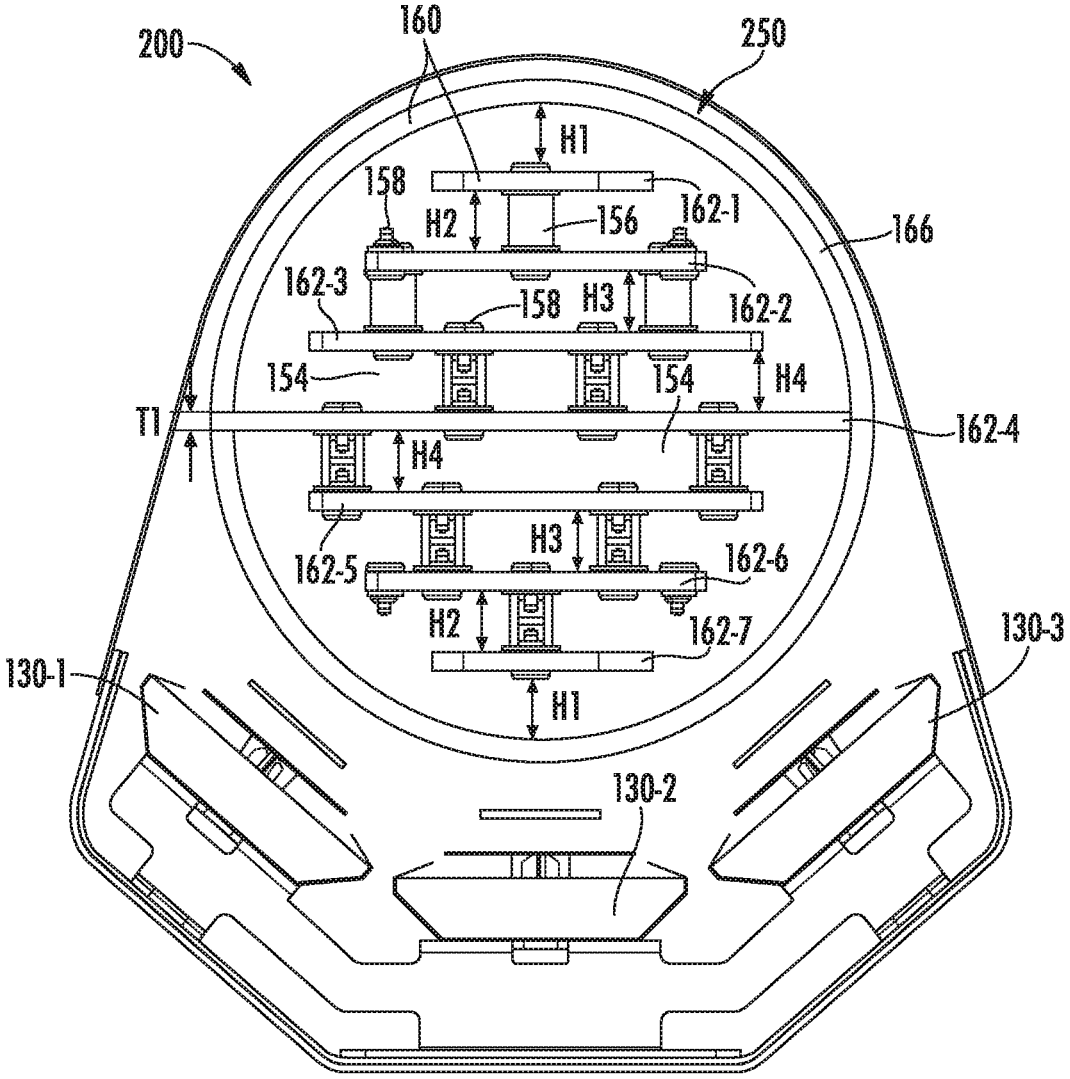
FIG. 2 is a schematic transverse cross-sectional view of a lensed base station antenna according to further embodiments of the present invention.

FIG. 2 is a transverse cross-sectional view of a lensed base station antenna 200 according to further embodiments of the present invention. The lensed base station antenna 200 may be identical to the lensed base station 100 described above, except that the RF lens 150 included in base station antenna 100 is replaced with an RF lens 250 in base station antenna 200. Accordingly, the description below will focus solely on the RF lens 250.

As shown in FIG. 2, the RF lens 250 is a skeletal lens that includes spaced-apart layers of dielectric material 160. The RF lens 250 does not include a separate outer dielectric shell 152. The spaced apart layers of dielectric material 160 again define air-filled channels 154 that have open side surfaces so that all of the channels 154 in the front half of the RF lens 250 are in communication with each other, and all of the channels 154 in the back half of the RF lens 250 are likewise in communication with each other.

The spaced-apart layers of dielectric material 160 included in the RF lens 250 are a total of seven flat sheets of dielectric material 162-1 through 162-7 that are spaced-apart from one another and that define parallel planes, as well as one cylindrical sheet of dielectric material 166 that defines the outer surface of the RF lens 250. The RF lens 250 further includes dielectric spacers 156 and dielectric fasteners 158 that are used to space the flat sheets of dielectric material 160 apart from one another and to interconnect the seven flat sheets of dielectric material 162 into a one-piece structure. The cylindrical sheet of dielectric material 166 is formed integrally with the middle flat sheet of dielectric material 162-4 so that the entire RF lens 250 is a one-piece unit. The dielectric spacers 156 may comprise, for example, hollow cylinders that are formed of a dielectric material. The cylinders may have closed ends that have respective openings (e.g., threaded holes) for receiving a fastener 158. The dielectric fasteners 158 may comprise, for example, plastic screws. It will be appreciated that the dielectric spacers 156 and dielectric fasteners 158 may be implemented in a wide variety of other ways. As another example, the dielectric fasteners 158 may comprise plastic nuts and bolts and the dielectric spacers 156 may comprise cylinders that have closed ends with smooth bore openings therein and openings in the sidewalls of the cylinders. The openings in the sidewalls may allow inserting the plastic nuts therein and each bolt may be threaded through an opening in a respective one of the flat sheets of dielectric material 162 and through the corresponding in the end of the three-sided cylinder 156, and into its corresponding nut.

In the RF lens 250 of FIG. 2, each flat sheet of dielectric material 162 is spaced apart from one or two adjacent flat sheets of dielectric material 162 by distances of H2, H3 or H4, The center of the front most flat sheet of dielectric material 162-1 is spaced apart from the cylindrical sheet of dielectric material 166 by a distance H1, and the center of the rearmost flat sheet of dielectric material 162-7 is similarly spaced apart from the cylindrical sheet of dielectric material 166 by the distance H1. The flat sheets of dielectric material 162 are symmetrically arranged in the RF lens 250, although this need not be the case. The flat sheets of dielectric material 162 may have different widths. As shown in FIG. 2, the flat sheet of dielectric material 162-4 that is in the center of RF lens 250 has the largest width, while the flat sheets of dielectric material 162-1, 162-7 at the front and rear of the RF lens 250, respectively have the smallest widths. The widths of the flat sheets of dielectric material 162 become increasingly smaller with increasing distance from the flat sheet of dielectric material 162-4 that is in the middle of RF lens 250.

Each flat sheet of dielectric material 162 may have a thickness. In the embodiment illustrated in FIG. 2, all of the flat sheets of dielectric material 162 have the same thickness T1, as does the cylindrical sheet of dielectric material 166, although the thicknesses may be varied in other embodiments. The thickness T1 may be between, for example, 5-15 millimeters in some embodiments. In other embodiments, the thickness T1 may be between 7-12 millimeters. In still other embodiments, the thickness T1 may be between 8-10 millimeters. In some embodiments, H1 may be larger than H2, H3 and H4. H1 may be, for example, between 30-50 millimeters in some embodiments, and between 35-45 millimeters in other embodiments. H2, H3 and H4 may be between, for example, 15-40 millimeters in some embodiments. In other embodiments, H2, H3 and H4 may be between 20-35 millimeters and in still other embodiments between 25-30 millimeters. In some embodiments, each distance H2, H3, H4 may be at least twice the thickness T1 of the dielectric sheets 162 that are separated by a particular air-filled channel 154. In other embodiments, each distance H2, H3, H4 may be at least three times the thickness T1 of the dielectric sheets 162 that are separated by a particular air-filled channel 154. For example, the sheets of dielectric material 162-5 and 162-6 may each have a thickness T1 and may be separated by an air filled channel having a depth distance of H3. H3 may be at least twice, or at least three times, the thickness T1.

It will be appreciated that the thickness(es) of the dielectric sheets, the dielectric constant(s) of the dielectric sheets and the size(s) of the gaps between adjacent dielectric sheets should be selected to optimize performance of the RF lenses according to embodiments of the present invention. Generally speaking, as the dielectric constant and/or the thickness of the dielectric sheets are increased, the spacing between adjacent dielectric sheets may also be increased. It will also be appreciated in light of the present disclosure that sheets of dielectric material that are spaced apart by air-filled channels behave differently in how they focus the RF energy than does a single solid block of dielectric material that has the same thickness.

Figure 3A:
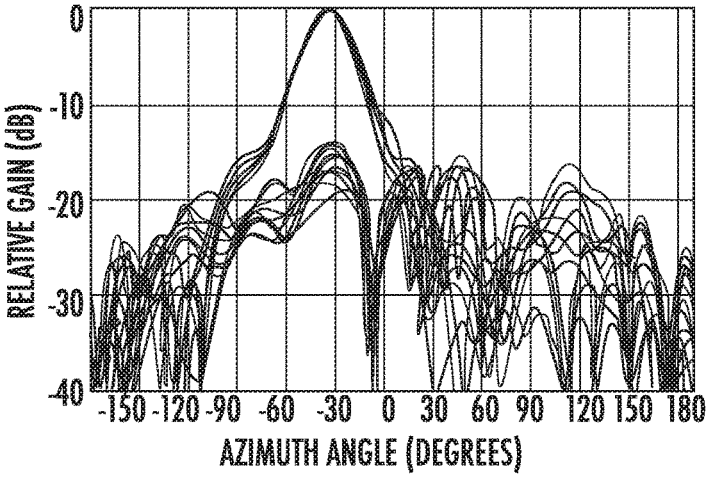
FIGS. 3A-3C are graphs illustrating the azimuth patterns of the first through third linear arrays, respectively, of the base station antenna of FIG. 2.
Figure 3B:
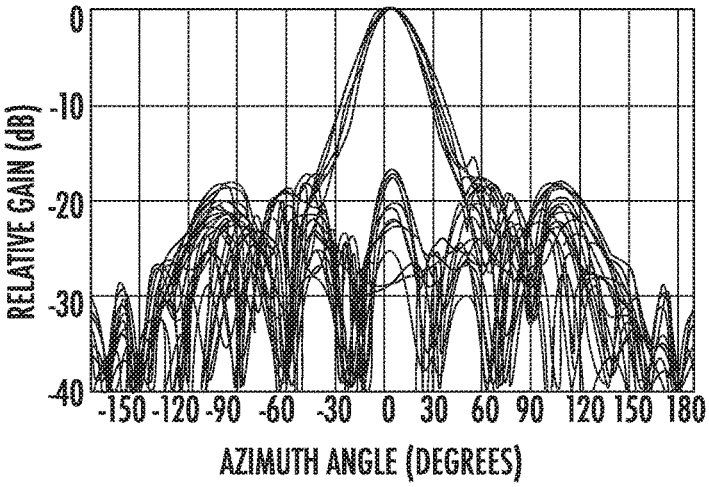
Figure 3C:
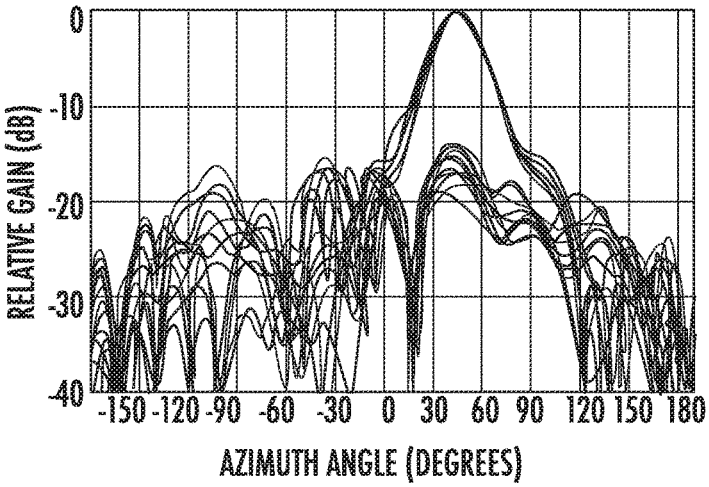

FIGS. 3A-3C are graphs illustrating the azimuth patterns of the first through third linear arrays, respectively, of the base station antenna of FIG. 2. The different curves in each of FIGS. 3A-3C represent simulated plots of the azimuth pattern at a variety of different frequencies across the 1695-2170 MHz frequency band, which is the operating frequency band for the linear arrays 130 of radiating elements 132 in base station antenna 200. Curves are provided showing both the co-polarization and cross-polarization azimuth patterns in each of FIGS. 3A-3C. Table I below summarizes various of the simulated performance parameters for base station antenna 200.

TABLE I

| Specification | Sub-Band 1 | Sub-Band 2 | Sub-Band 3 |
|---|---|---|---|
| Sub-Band Frequency Range (MHz) | 1695-1880 | 1820-1990 | 1920-2170 |
| Azimuth 3 dB Beamwidth (Degrees) | 26 | 25 | 24 |
| Peak Azimuth Sidelobe (dB) | 15.3 | 15 | 14.9 |
| Front-to-Back Ratio, 180° +/− 30° Region (dB) | 25 | 24 | 24 |
| Cross-Pol Discrimination at Boresight (dB) | 15 | 15 | 15 |

As shown in TABLE I, the 3 dB azimuth beamwidth for each beam is between 24° and 26° depending upon the particular sub-band in which the linear arrays 130 are operating. Typically, a 3 dB azimuth beamwidth of about 23° is optimum for an antenna that provides three antenna beams per sector, and values in the range of 24°-26° are acceptable for most if not all sector-splitting applications. The peak azimuth sidelobes are about 15 dB below the peak gain of each antenna beam, which again is acceptable performance. The front-to-back ratio and cross-polarization discrimination performance are also in acceptable ranges. Thus, the simulated results shown in TABLE I indicate that the base station antenna 200 provides acceptable performance for a three sub-sector sector splitting application. This performance is achieved with an RF lens 250 that may be cheaper to manufacture, potentially lighter, that is more reliable (as it may not be subject to degradation due to heat build-up issues), and that is not a potential source of PIM distortion.

Figure 4:
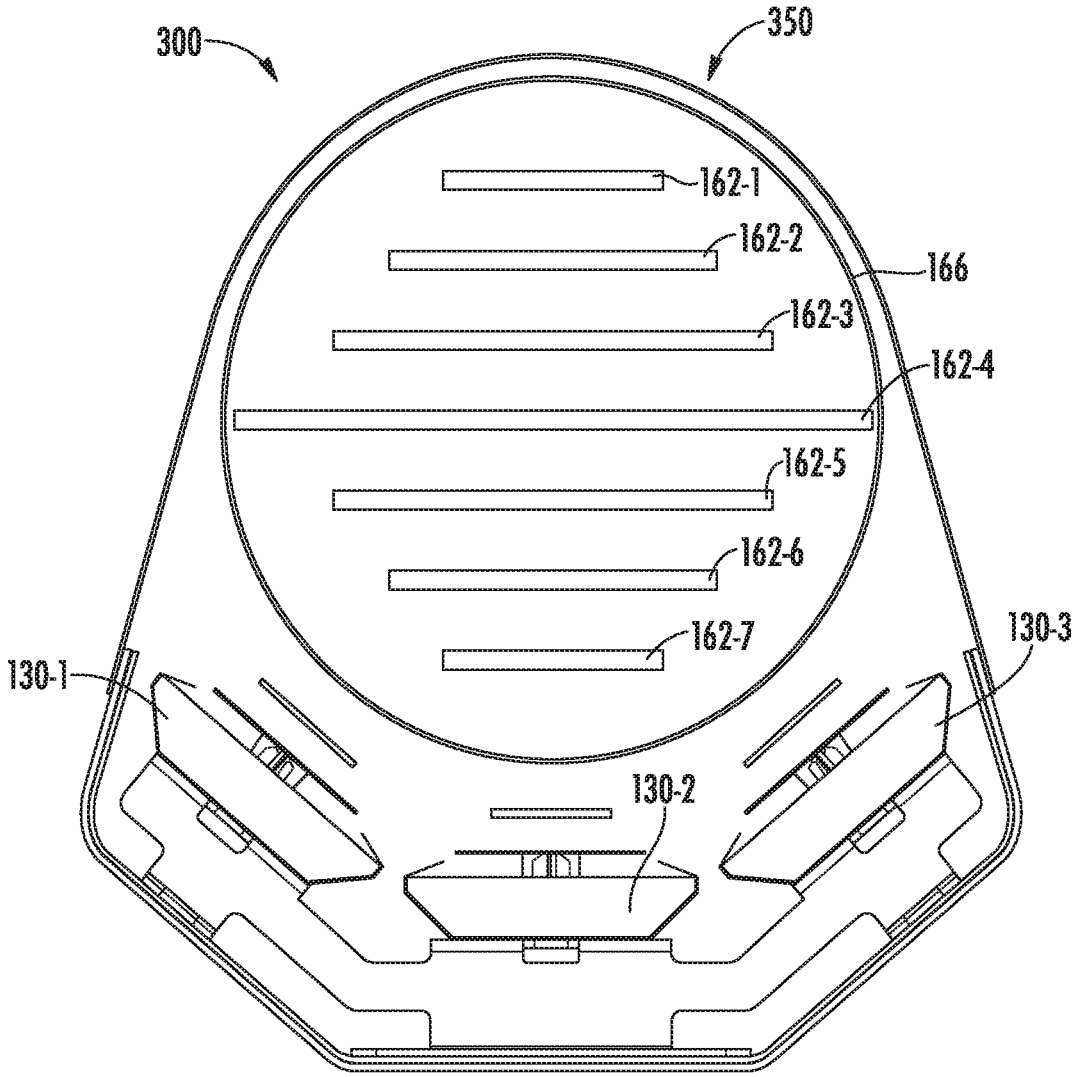
FIG. 4 is a schematic transverse cross-sectional view of a lensed base station antenna according to still further embodiments of the present invention.

FIG. 4 is a schematic transverse cross-sectional view of a lensed base station antenna 300 according to still further embodiments of the present invention. The lensed base station antenna 300 may be nearly identical to the lensed base station 200 described above, except that the RF lens 150 included in base station antenna 100 is replaced with an RF lens 350 in base station antenna 300. Accordingly, the description below will focus solely on the RF lens 350. The RF lens 350 is very similar to the RF lens 250 included in base station antenna 200, so the description that follows will only focus on the differences between these two lenses.

As shown in FIG. 4, the RF lens 350 is also a skeletal lens that includes spaced-apart layers of dielectric material 160 in the form of seven parallel, spaced-apart flat sheets of dielectric material 162 and a cylindrical sheet of dielectric material 166 (which in base station antenna 300 is smaller than the corresponding cylindrical sheet of dielectric material 166 that is included base station antenna 200) that defines the outer surface of the RF lens 350. The cylindrical sheet of dielectric material 166 may be omitted in some embodiments. The spaced apart layers of dielectric material 160 again define air-filled channels 154 that have open side surfaces. The dielectric spacers 156 and dielectric fasteners 158 that are included in RF lens 250 are omitted in RF lens 350. Instead, the top and bottom end caps 116, 118 of antenna 300 (see FIG. 1A) may include internal elongated channels that are configured to receive the respective tops and bottoms of the flat sheets of dielectric material 162. The top and bottom end caps 116, 118 may also include respective internal channels having a circular shape that are configured to receive the respective top and bottom of the cylindrical sheet of dielectric material 166. Alternatively or additionally, a separate lens support structure (not shown) may be provided that is used to hold the RF lens 350 in its proper place within base station antenna 300. As base station antenna 300 may otherwise be substantially identical to base station 200, further description thereof will be omitted. Base station antenna 300 may have substantially identical performance to base station antenna 200.

Figure 5:
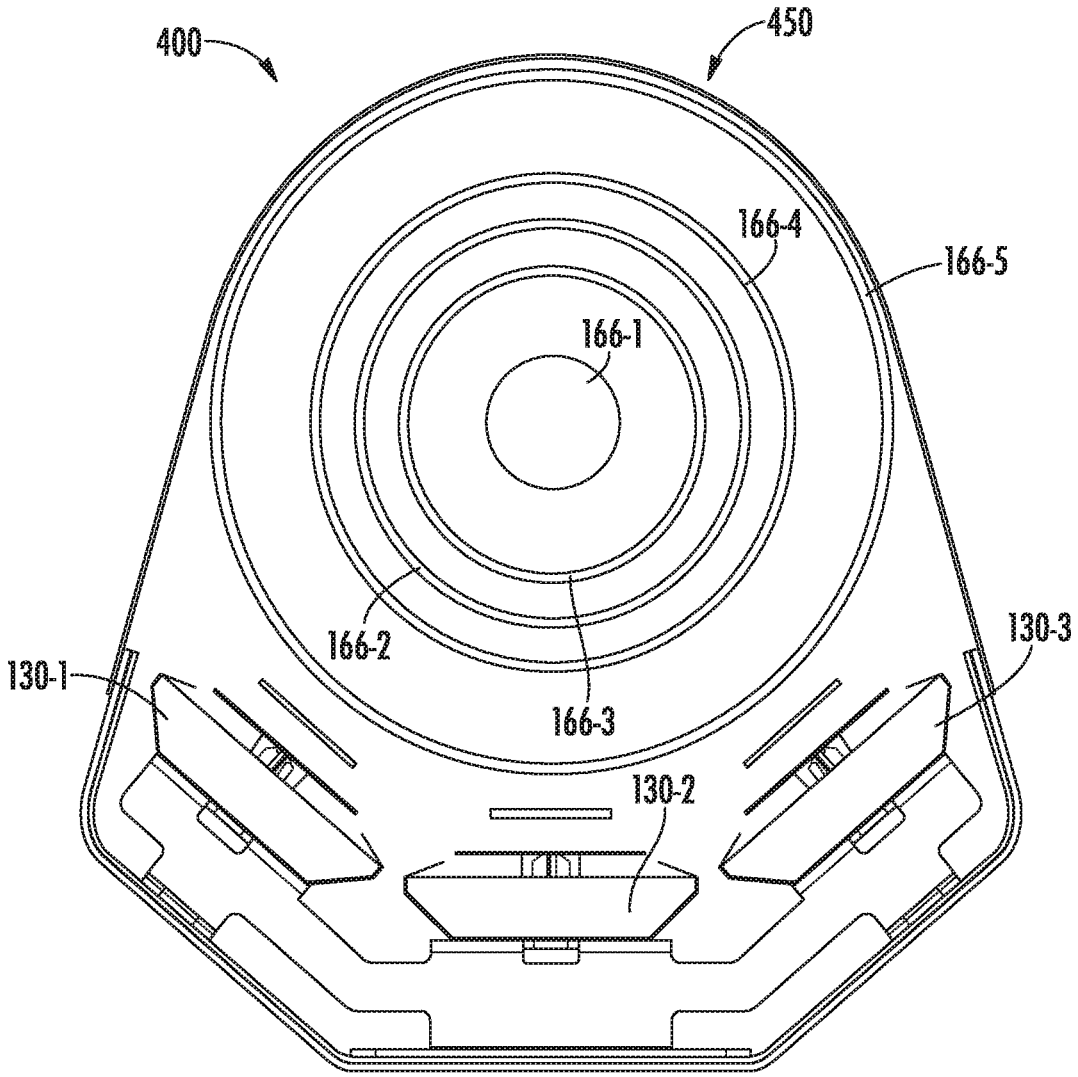
FIG. 5 is a schematic transverse cross-sectional view of a lensed base station antenna according to additional embodiments of the present invention.

FIG. 5 is a schematic transverse cross-sectional view of a lensed base station antenna 400 according to additional embodiments of the present invention. The lensed base station antenna 400 may be nearly identical to the lensed base station 300 described above, except that the RF lens 350 included in base station antenna 300 is replaced with an RF lens 450 in base station antenna 400. Accordingly, the description below will focus on the RF lens 450.

The RF lens 450 differs from RF lens 350 in that RF lens 450 includes a plurality of cylindrical sheets of dielectric material 166-1 through 166-5 and does not include any flat sheets of dielectric material. The central cylindrical sheet of dielectric material 166-1 may comprise a solid cylinder of dielectric material (as shown), while the remaining four cylindrical sheets of dielectric material 166-2 through 166-5 may comprise open cylinders having annular shapes. Thus, the RF lens 450 comprises a plurality of concentric annular cylinders of dielectric material that surround a solid cylinder of dielectric material. While the central "sheet" of dielectric material 166-1 is implemented as a solid cylinder of dielectric material in the depicted embodiment, it will be appreciated that it may be replaced with a cylinder of dielectric material having an opening interior in other embodiments. Typically, the top and bottom of each concentric dielectric cylinder will be open to simplify the manufacture of the RF lens 450, but this need not be the case.

The boresight pointing direction of each of the linear arrays 130 is directly through the solid dielectric cylinder 166-1, which is relatively thick. As such, cylinder 166-1 may perform a significant amount of focusing on the RF energy emitted by each linear array 130. Additionally, cylindrical sheets of dielectric material 166-2 through 166-4 are positioned relatively close to cylindrical sheet of dielectric material 166-1, which may increase the amount of dielectric material that the RF energy emitted by each linear array 130 passes through when traversing the RF lens 450, since the RF energy may not only pass through the "front" and back" of each cylindrical sheet of dielectric material 166-2 through 166-4, but also through the "sides' of the sheets where the RF energy will pass through a greater amount of dielectric material. The RF lens 450 may be supported in the base station antenna 400 using appropriately-shaped channels in the top and bottom end caps 116, 118 and/or with a separate support structure (not shown), as is the case with RF lens 350, and/or by using dielectric spacers 156 and dielectric fasteners 158, as is the case with RF lens 250.

Figure 6A:
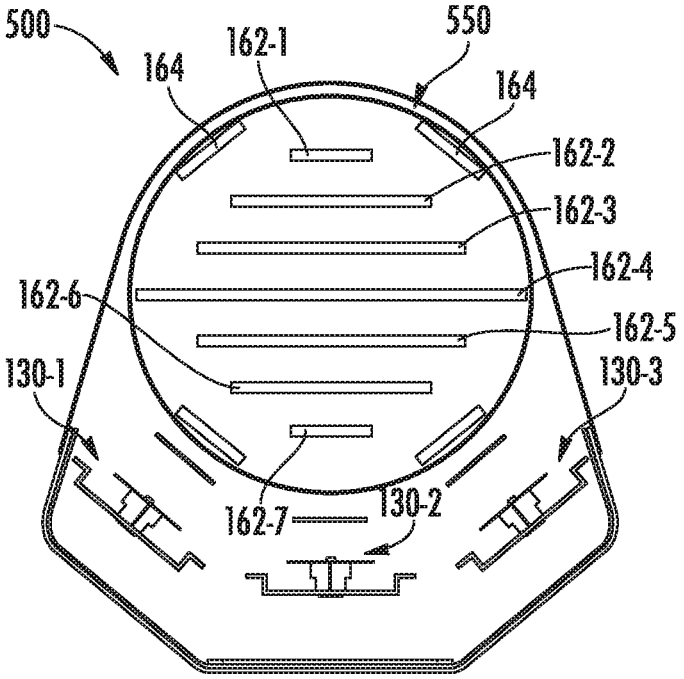
FIG. 6A is a schematic transverse cross-sectional view of a lensed base station antenna according to yet additional embodiments of the present invention.
Figure 6B:
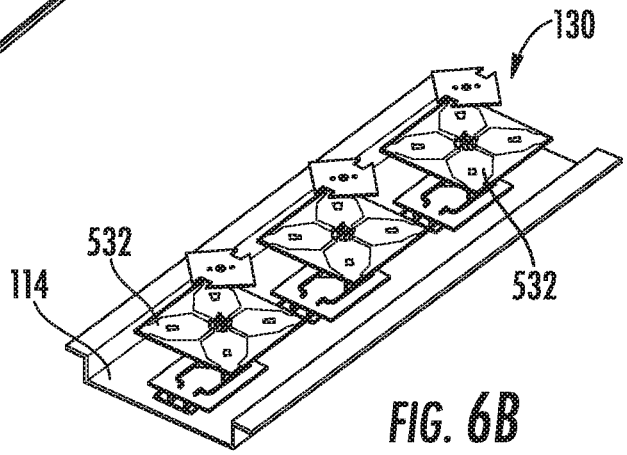
FIG. 6B is an enlarged perspective view of a portion of one of the linear arrays of radiating elements illustrated in FIG. 6A.
Figure 6C:
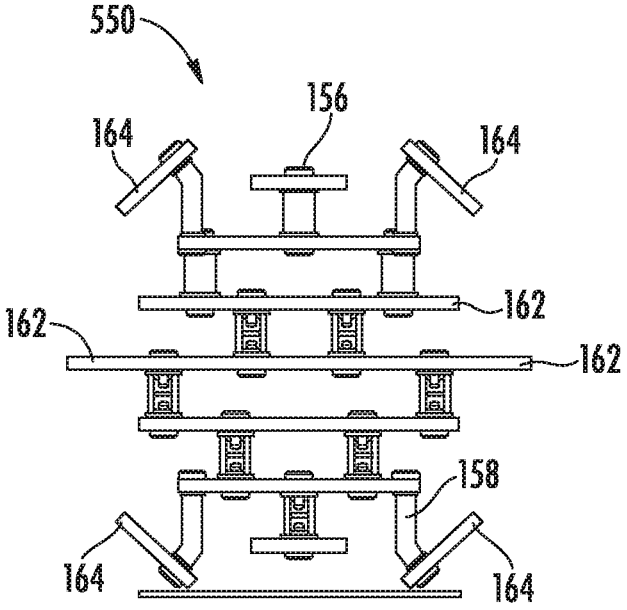
FIG. 6C is a schematic transverse cross-sectional view of the RF lens included in the lensed base station antenna of FIG. 6A, illustrating a plurality of fasteners that may be used to connect the dielectric sheets into a unitary structure.

FIGS. 6A-6C illustrate a base station antenna 500 according to further embodiments of the present invention. In particular, FIG. 6A is a schematic transverse cross-sectional view of the base station antenna 500, FIG. 6B is an enlarged perspective view of a portion of one of the linear arrays 130 of radiating elements 532 included in base station antenna 500, and FIG. 6C is a more detailed transverse cross-sectional view of the RF lens 550 included in the lensed base station antenna 500. The lensed base station antenna 500 is very similar to the lensed base station 200 described above, except the radiating elements 532 included in the linear arrays 130 of base station antenna 500 differ from the radiating elements 132, and the RF lens 550 included in base station antenna 500 includes four angled flat sheets of dielectric material 164 that are not present in the RF lens 250 of base station antenna 200. The description below will focus on the differences between base station antenna 500 and base station antenna 200.

As shown in FIGS. 6A and 6C, the RF lens 550 is a skeletal lens that includes spaced-apart layers of dielectric material 160 that define open-sided air-filled channels 154. The spaced-apart layers of dielectric material 160 include seven parallel, flat sheets of dielectric material 162 that are identical to the flat sheets of dielectric material 162 included in RF lens 250 as well as four additional flat sheets of dielectric material 164 that are angled with respect to the seven parallel, flat sheets of dielectric material 162. The RF lens 550 may optionally include a cylindrical sheet of dielectric material 166 that surrounds the flat sheets of dielectric material 162, 164 and that defines the outer surface of the RF lens 550. The RF lens 550 further includes dielectric spacers 156 and dielectric fasteners 158 that are used to interconnect the flat sheets of dielectric material 162, 164 into a one-piece structure.

The four additional flat sheets of dielectric material 164 provide additional focusing of the RF energy emitted by the linear arrays 130 of radiating elements 532. The four additional flat sheets of dielectric material 164 are positioned to primarily focus RF energy emitted by linear arrays 130-1 and 130-3. In particular, first and second flat sheets of dielectric material 164-1, 164-2 are positioned along the rear side of RF lens 550 directly in front of linear arrays 130-1, 130-3, respectively and third and fourth flat sheets of dielectric material 164-3, 164-4 are positioned along the front side of the RF lens 550 at the azimuth boresight pointing directions of linear arrays 130-1 and 130-3, respectively. As can be seen best in FIG. 6A, RF energy from linear arrays 130-1 and 130-3 may pass through less dielectric material of the seven parallel, flat sheets of dielectric material 162 since sheets 162-1 and 162-7 have small widths and hence are not along the respective azimuth boresight pointing directions of linear arrays 130-1 and 130-2. As such, the RF energy emitted by linear arrays 130-1, 130-3 may undergo less focusing by the seven parallel, flat sheets of dielectric material 162 as compared to the RF energy emitted by linear array 130-2. The addition of the four flat sheets of dielectric material 164-1 through 164-4 may compensate for this reduced amount of focusing to sufficiently narrow the azimuth beamwidths of linear arrays 130-1, 130-3.

As noted above, base station antenna 500 uses a different type of radiating element 532 to form the linear arrays 130 than is used in base station antenna 200. Several of the radiating elements 532 are depicted in FIG. 6B. The radiating elements 532 are ultra-wideband radiating elements that are designed to operate over the full 1695-2690 MHz frequency band. Directors 534 were added to each radiating element 532 as well.

Figure 7A:
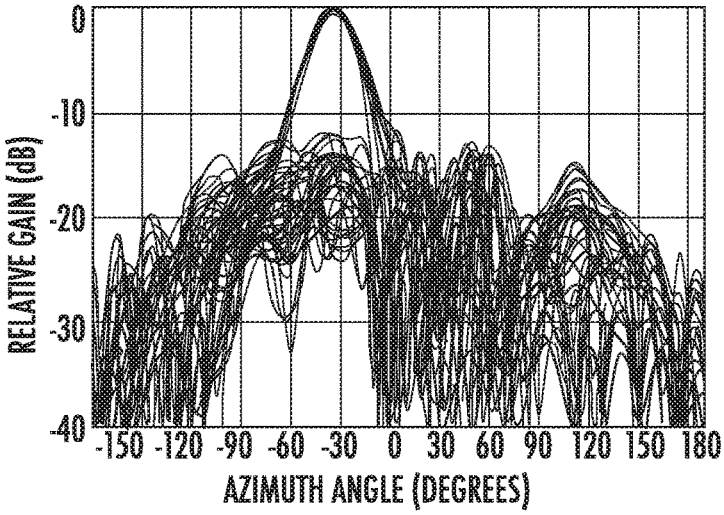
FIGS. 7A-7C are graphs illustrating the azimuth patterns of the first through third linear arrays, respectively, of the base station antenna of FIGS. 6A-6C.
Figure 7B:
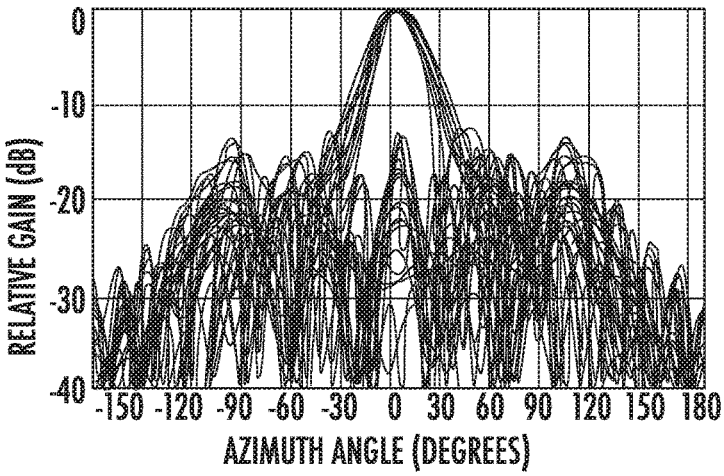
Figure 7C:
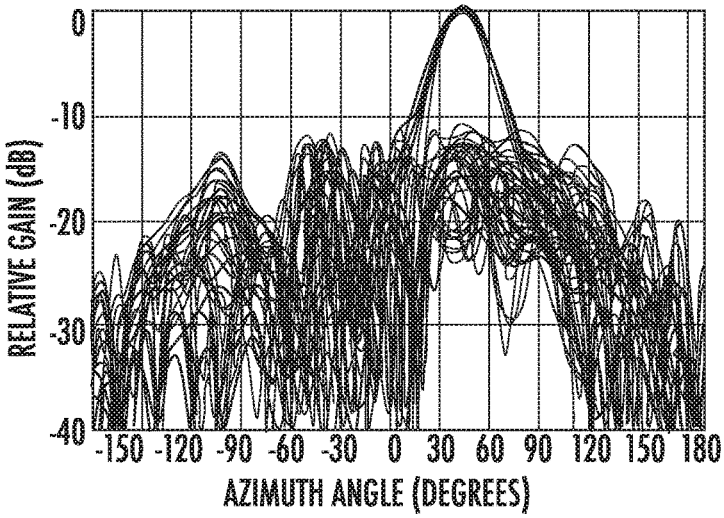

FIGS. 7A-7C are graphs illustrating the azimuth patterns of the first through third linear arrays, respectively, of the base station antenna of FIGS. 6A-6C. The different curves in each of FIGS. 7A-7C represent simulated plots of the azimuth pattern at a variety of different frequencies across the 1695-2690 MHz frequency band, which is the operating frequency band for the linear arrays 130 of radiating elements 532 in base station antenna 500. Curves are provided showing both the co-polarization and cross-polarization azimuth patterns in each of FIGS. 7A-7C. Table II below summarizes various of the simulated performance parameters for base station antenna 500.

TABLE II

| Specification | Sub-Band 1 | Sub-Band 2 | Sub-Band 3 | Sub-Band 4 |
|---|---|---|---|---|
| Sub-Band Frequency Range (MHz) | 1695-1880 | 1920-2170 | 2300-2400 | 2500-2690 |
| Azimuth 3 dB Beamwidth (Degs) | 26.5 | 25 | 26 | 23 |
| Peak Azimuth Sidelobe (dB) | 15 | 15 | 14 | 13 |
| Front-to-Back Ratio (dB) | 25 | 24 | 23 | 25 |
| Cross-Pol. Discrimination (dB) | 15 | 15 | 15 | 14 |

As shown in TABLE II, the base station antenna 500 may be designed to operate in four different sub-bands within the 1695-2690 MHz frequency range. The performance across all four sub-bands is highly consistent. For example, the 3 dB azimuth beamwidth for each beam is between 23° and 26.5° depending upon the particular sub-band in which the linear arrays 130 are operating. The peak azimuth sidelobes vary between 13 dB to 15 dB below the peak gain of each antenna beam, which represents acceptable performance. The front-to-back ratio and cross-polarization discrimination performance are also in acceptable ranges. Thus, the simulated results shown in TABLE II indicate that the base station antenna 500 provides acceptable performance for a three sub-sector sector splitting application across the entire 1695-2690 MHz frequency range.

The embodiments of the present invention discussed above have all been tri-beam antennas that include three linear arrays of radiating elements that are used to split a 120° sector into three 40° sub-sectors. It will be appreciated, however, that embodiments of the present invention are not limited thereto.

Figure 8A:
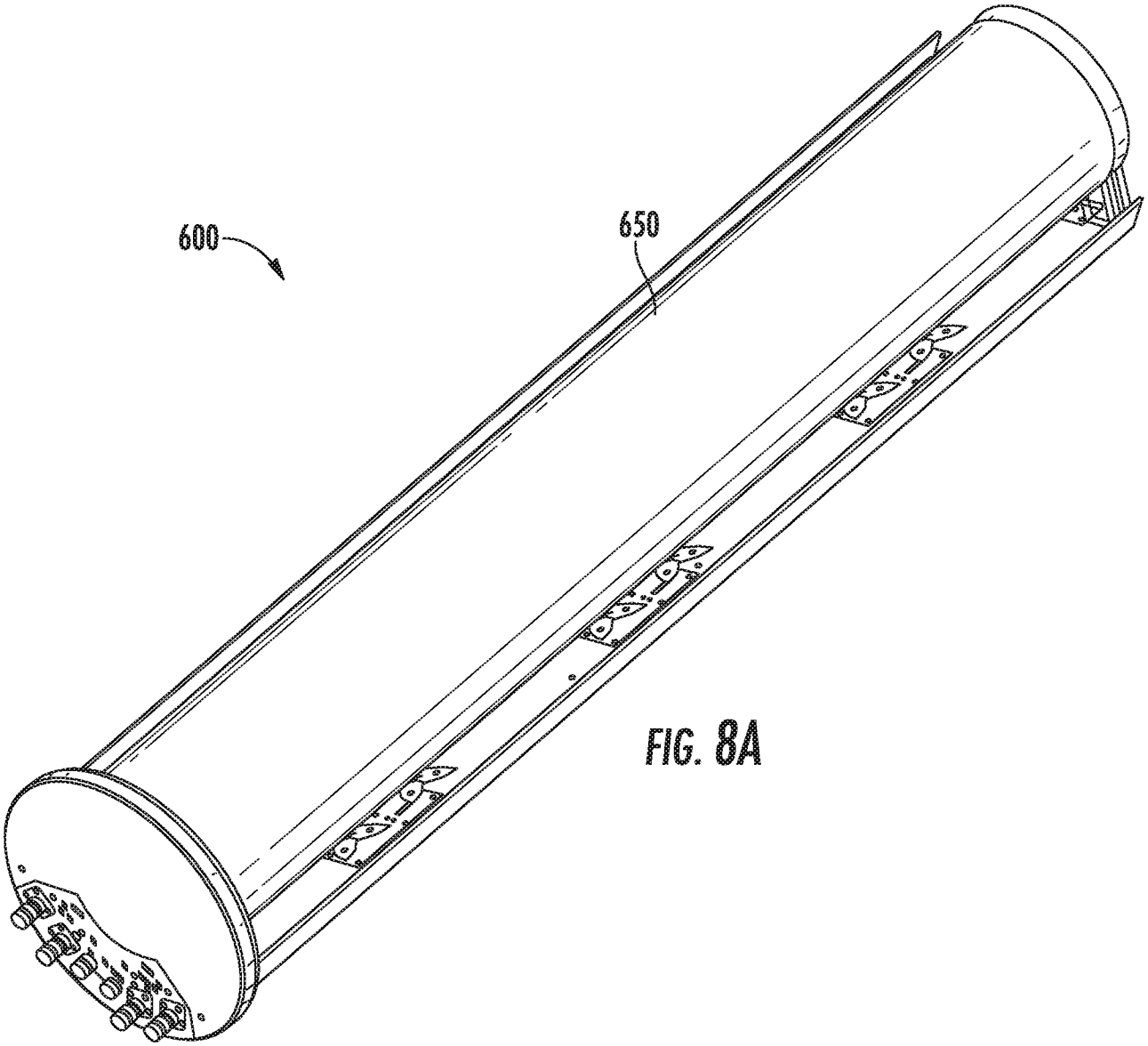
FIG. 8A is a schematic perspective view of a dual-beam base station antenna (with its radome omitted) according to embodiments of the present invention.
Figure 8B:
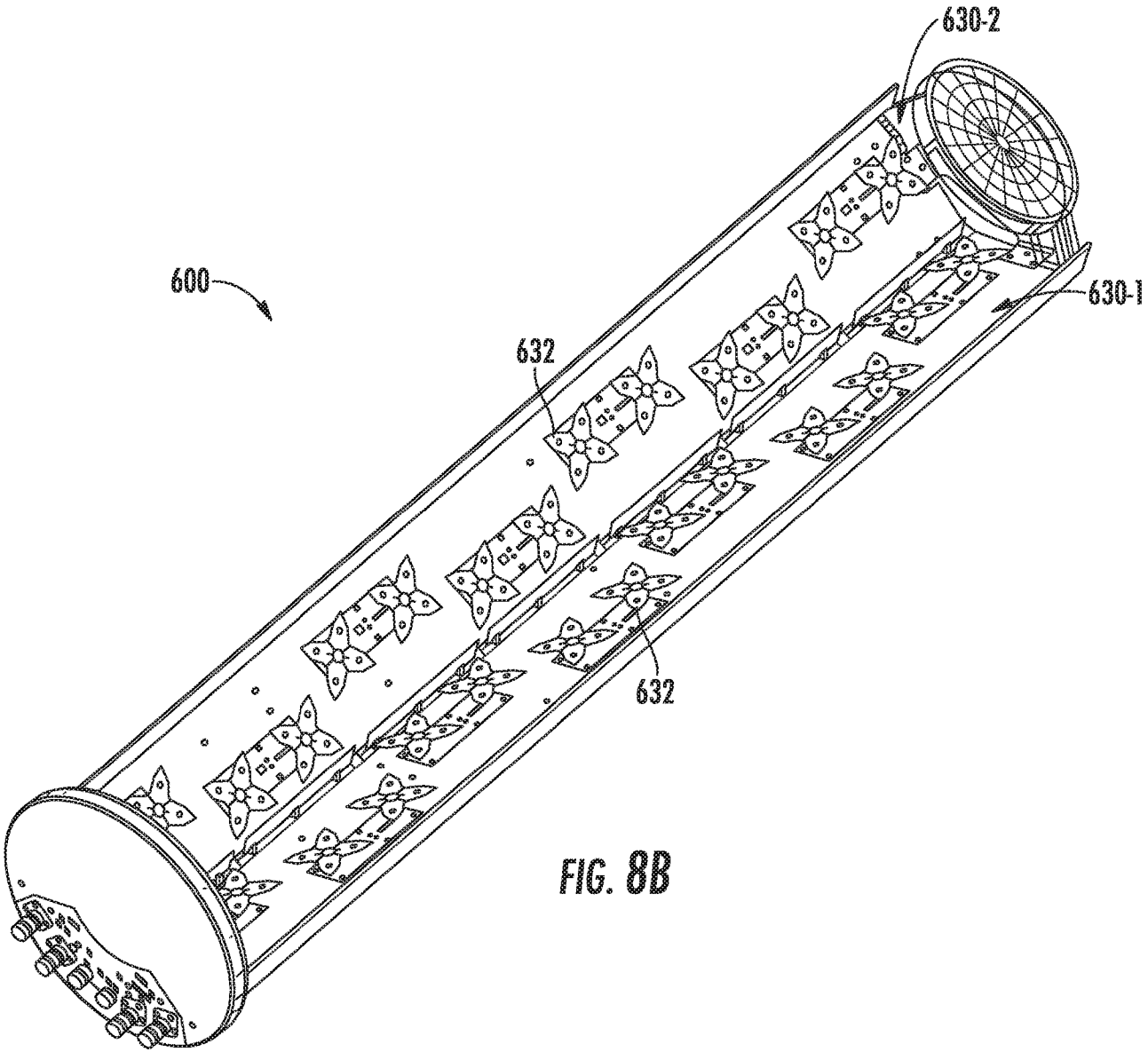
FIG. 8B is a schematic cross-sectional view of the dual-beam antenna of FIG. 8A with the RF lens also omitted to show the underlying arrays of radiating elements.

For example, FIG. 8A is a schematic perspective view of a dual-beam base station antenna 600 (with its radome omitted) according to embodiments of the present invention. FIG. 8B is a schematic perspective view of the dual-beam antenna 600 with the RF lens 650 omitted to show the underlying arrays of radiating elements of base station antenna 600. The RF lens 650 may, for example, be implemented using any of the RF lens designs discussed herein. Moreover, these RF lens designs may also be modified to (1) perform less focusing of the RF energy (since base station antenna is a dual-beam antenna that is designed to split a sector into two 60° sub-sectors in the azimuth plane) and/or (2) to have the dielectric material more appropriately arranged with respect to the two linear arrays of radiating elements.

Figure 8C:
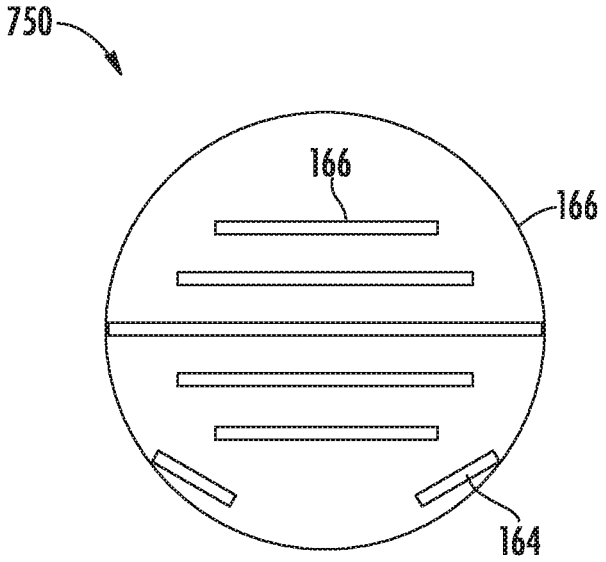
FIG. 8C is a schematic transverse cross-sectional view of an RF lens according to further embodiments of the present invention.
Figure 8D:
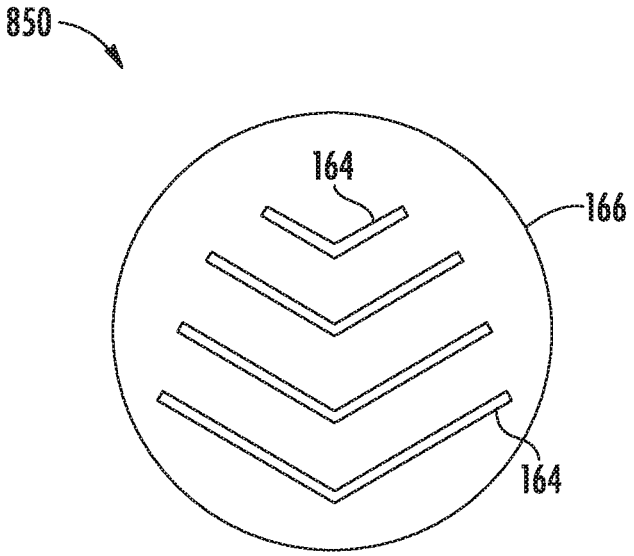
FIG. 8D is a schematic transverse cross-sectional view of an RF lens according to still further embodiments of the present invention.

For example, FIG. 8C illustrates an RF lens 750 that may be used to implement the RF lens 650 of base station antenna 600. As can be seen by comparing FIGS. 6A and 8C, the number of flat sheets of dielectric material 162 is reduced from seven in RF lens 550 to five in RF lens 750, and the number flat sheets of dielectric material 164 is reduced from four in RF lens 550 to two in RF lens 750, as less focusing of the RF energy is required for the twin beam antenna 600. Additionally, the first and second flat sheets of dielectric material 164 are angled slightly differently in RF lens 750 so that they are perpendicular to the azimuth boresight pointing directions of linear arrays 630-1 and 630-2, respectively. FIG. 8D illustrates another RF lens 850 that could be used to implement the RF lens 650 in base station antenna 600. As shown in FIG. 8D, RF lens 850 includes a plurality of flat sheets of dielectric material 162 that are bent to form V-shaped sheets of dielectric material.

It will likewise be appreciated that the non-lens portions of the base station antennas according to embodiments of the present invention may have any appropriate design, including different numbers of linear arrays, different array designs, different types of radiating elements, etc. This is illustrated, for example, in FIGS. 8A-8B, which show that the base station antenna 600 includes "staggered" linear arrays 630-1, 630-2 of radiating elements 632 as opposed to conventional straight linear arrays. As shown in FIG. 8B, the base station antenna 600 has a V-shaped reflector and the radiating elements 632 in the linear arrays 630 includes a small "stagger" so that the radiating elements 632 in a given array 630 are not all aligned along a common vertical axis, but instead some of the radiating elements 632 are offset horizontally from other of the radiating elements 632 by a small amount. In the particular example illustrated in FIGS. 8A-8B, all of the radiating elements 632 in a given array 630 are aligned along one of two vertical axes. As explained in U.S. Provisional Patent Application Ser. No. 62/722,238, filed Aug. 24, 2018, the entire content of which is incorporated herein by reference, such staggered linear arrays may be included in base station antennas in order to improve the stability of the azimuth beamwidth across the frequency band of operation.

It will also be appreciated that more than one RF lens may be included in the base station antennas according to embodiments of the present invention. For example, the base station antennas described above each included a single circular cylindrical RF lens that extended the entire length of the antenna. It will be appreciated, however, that these circular cylindrical antennas could be replaced with a stack of multiple circular cylindrical RF lenses that may be identical to the above-described RF lens except that each RF lens may have a shorter height. These shorter RF lenses could be stacked to provide a multi-piece RF lens having the exact same shape as the RF lenses described above. Alternatively, small gaps could be provided between the stacked lens to further facilitate air flow through the heat dissipation pipes.

The RF lenses according to embodiments of the present invention are primarily shown in transverse cross-section in the drawings. It will be appreciated that the sheets of dielectric material that are used to form the RF lenses according to embodiments of the present invention may extend the entire length of the RF lenses in the longitudinal direction of the RF lens. Typically, a length (i.e., a distance in the longitudinal direction of the base station antenna) of each sheet of dielectric material will be slightly larger than the length of the radiating elements of the base station antenna that the RF lens is associated with.

It will be appreciated that the present specification only describes a few example embodiments of the present invention and that the techniques described herein have applicability beyond the example embodiments described above. It should also be noted that the antennas according to embodiments of the present invention may be used in applications other than sector-splitting such as, for example, in venues such as stadiums, coliseums, convention centers and the like. In such applications, the multiple beams are more usually configured to cover a 60°-90° sector.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

What is claimed is:

1. A lensed base station antenna, comprising:

a first array that includes a plurality of first radiating elements that are configured to transmit respective sub-components of a first radio frequency ("RF") signal;

a second array that includes a plurality of second radiating elements that are configured to transmit respective sub-components of a second RF signal; and a skeletal RF lens positioned to receive electromagnetic radiation from the first radiating elements and from the second radiating elements;

wherein the skeletal RF lens includes a plurality of layers of dielectric material that are separated by air gaps such that the first and second RF signals alternatingly pass through the layers of dielectric material where the RF energy is highly focused and then through air channels that are thicker than the layers of dielectric material where the RF energy is not focused.

2. The lensed base station antenna according to claim 1, wherein the plurality of layers of dielectric material comprises at least one of a plurality of spaced-apart flat sheets of dielectric material and a plurality of concentric cylinders of dielectric material.

3. The lensed base station antenna according to claim 2, wherein the base station antenna extends along a longitudinal axis, and wherein a thickness of at least some of the layers of dielectric material in a depth dimension of the base station antenna is at least 6 millimeters.

4. The lensed base station antenna according to claim 1, wherein the plurality of layers of dielectric material comprise a plurality of spaced-apart flat sheets of dielectric material that are arranged to be substantially parallel to each other.

5. The lensed base station antenna according to claim 4, wherein the spaced-apart flat sheets of dielectric material are spaced apart from each other in a depth dimension of the base station antenna.

6. The lensed base station antenna according to claim 4, wherein the plurality of spaced-apart flat sheets of dielectric material that are arranged to be substantially parallel to each other comprise a first set of spaced-apart flat sheets of dielectric material, the RF lens further comprising a second set of flat sheets of dielectric material that each extend at a respective angle with respect to the flat sheets of dielectric material in the first set of spaced-apart flat sheets of dielectric material.

7. The lensed base station antenna according to claim 4, wherein a thickness of at least some of the spaced-apart flat sheets of dielectric material in a depth dimension of the base station antenna is between 6 millimeters and 12 millimeters, and at least two adjacent ones of the spaced-apart flat sheets of dielectric material are separated by between 15 millimeters and 40 millimeters.

8. The lensed base station antenna according to claim 4, wherein the plurality of spaced-apart flat sheets of dielectric material that are arranged to be substantially parallel to each other includes a proximate flat sheet of dielectric material that is closest to the first array, a distal flat sheet of dielectric material that is farthest from the first array and at least one central flat sheet of dielectric material that is between the proximate flat sheet of dielectric material and the distal flat sheet of dielectric material, wherein a width of the at least one central flat sheet of dielectric material exceeds a width of the proximate flat sheet of dielectric material and a width of the distal flat sheet of dielectric material.

9. The lensed base station antenna according to claim 4, wherein the plurality of spaced-apart flat sheets of dielectric material that are arranged to be substantially parallel to each other includes at least five spaced-apart flat sheets of dielectric material.

10. A lensed base station antenna, comprising:

a first array that includes a plurality of first radiating elements that are configured to transmit respective sub-components of a first radio frequency ("RF") signal;

a second array that includes a plurality of second radiating elements that are configured to transmit respective sub-components of a second RF signal; and a skeletal RF lens positioned to receive electromagnetic radiation from the first radiating elements and from the second radiating elements;

wherein the skeletal RF lens comprises a plurality of spaced-apart flat sheets of dielectric material that are arranged to be substantially parallel to each other.

11. The lensed base station antenna according to claim 10, wherein the spaced-apart flat sheets of dielectric material are substantially perpendicular to an azimuth boresight pointing direction of the base station antenna.

12. The lensed base station antenna according to claim 10, wherein the base station antenna extends along a longitudinal axis, and wherein a thickness of at least some of the spaced-apart flat sheets of dielectric material in a depth dimension of the base station antenna is at least 6 millimeters.

13. The lensed base station antenna according to claim 10, wherein the spaced-apart flat sheets of dielectric material are spaced apart from each other in a depth dimension of the base station antenna.

14. The lensed base station antenna according to claim 10, wherein the plurality of spaced-apart flat sheets of dielectric material that are arranged to be substantially parallel to each other comprise a first set of spaced-apart flat sheets of dielectric material, the RF lens further comprising a second set of flat sheets of dielectric material that each extend at a respective angles with respect to the flat sheets of dielectric material in the first set of spaced-apart flat sheets of dielectric material.

15. The lensed base station antenna according to claim 10, wherein a thickness of at least some of the spaced-apart flat sheets of dielectric material in a depth dimension of the base station antenna is between 6 millimeters and 12 millimeters, and at least two adjacent ones of the spaced-apart flat sheets of dielectric material are separated by between 15 millimeters and 40 millimeters.

16. A base station antenna, comprising:

a first array that includes a plurality of first radiating elements that are configured to transmit respective sub-components of a first radio frequency ("RF") signal;

a second array that includes a plurality of second radiating elements that are configured to transmit respective sub-components of a second RF signal; and an RF lens positioned to receive electromagnetic radiation from the first radiating elements and from the second radiating elements;

wherein a section of the RF lens that extends along an azimuth boresight pointing direction of a first of the first radiating elements comprises at least first through fourth regions of dielectric material that are at least 3 millimeters thick and that have a dielectric constant of at least 2.5, where each of the first through fourth regions of dielectric material are separated by respective first through third air gaps.

17. The lensed base station antenna according to claim 16, wherein an interior of the RF lens substantially consists of sheets of dielectric material separated by air-filled chambers.

18. The lensed base station antenna according to claim 16, wherein a thickness of each of the first through fourth regions of dielectric material is at least 6 millimeters.

19. The lensed base station antenna according to claim 16, wherein the first through fourth regions of dielectric material comprise first through fourth spaced-apart sheets of dielectric material that are arranged to be substantially parallel to each other.

20. The lensed base station antenna according to claim 19, wherein a thickness of each of the first through fourth spaced-apart sheets of dielectric material in a depth dimension of the base station antenna is between 6 millimeters and 12 millimeters, and at least two adjacent ones of the first through fourth spaced-apart sheets of dielectric material are separated by between 15 millimeters and 40 millimeters.

21. The lensed base station antenna according to claim 19, wherein the first through fourth spaced-apart sheets of dielectric material are interconnected by a plurality of dielectric fasteners that connect adjacent ones of the spaced-apart sheets of dielectric material.

* * * * *